United States Patent [19]

Perini

[11] Patent Number: 4,475,974

[45] Date of Patent: Oct. 9, 1984

[54] APPARATUS AND METHOD FOR GLUEING THE OUTER END OF A STICK OF WOUND PAPER MATERIAL

[76] Inventor: Fabio Perini, P.O. Box 338 (Mugnano), 55100 Lucca, Italy

[21] Appl. No.: 444,567

[22] Filed: Nov. 26, 1982

[30] Foreign Application Priority Data

Dec. 3, 1981 [IT] Italy ..... 9580 A/81

[51] Int. Cl.[3] ..... B65H 19/26

[52] U.S. Cl. ..... 156/187; 156/456; 156/457; 242/56 W

[58] Field of Search ..... 156/446–449, 156/456–458, 184, 187, 191, 356–357; 242/56 W, 56 A

[56] References Cited

U.S. PATENT DOCUMENTS

| | | | |
|---|---|---|---|
| 3,404,059 | 10/1968 | Ritterhoff | 156/456 X |
| 3,430,881 | 3/1969 | Ebneter | 242/56 A |
| 3,553,055 | 1/1971 | Vanik | 156/450 |
| 3,734,423 | 5/1973 | Kataoka | 242/56 A |
| 4,299,642 | 11/1981 | Berkholty | 242/56 R |

*Primary Examiner*—David A. Simmons

[57] ABSTRACT

The apparatus comprises: a plurality of pairs of support rollers 43 for receiving a stick of rolled paper 44, rotating it, stopping its rotation and supporting it in successive phases X,Y,Z; a chain conveyor 27,29 for moving the pairs of support rollers 43 to transfer each pair in turn from a station for receiving the stick 44X and opening the end 44L to the station for glueing the end and to the station for closing the outer end 44L on the stick 44Y; means 9,91,93,95 for rotating each pair of support rollers and the supported stick at the receiving station and for stopping it after the opening of the edge 44L; blast air means 133,135, for opening the edge 44L; a flat projection 83 for supporting the open end 44L and means 137,139 for distributing glue on the edge; and means 109,131,125 for rotating the stick, supported on the pair of support rollers 43 to close and press the end after glueing. Rolled sticks 44 are fed from a rolling machine onto the support rollers 43. The need for axial engagement of the sticks and consequent precise alignment is avoided.

14 Claims, 5 Drawing Figures

Fig.4
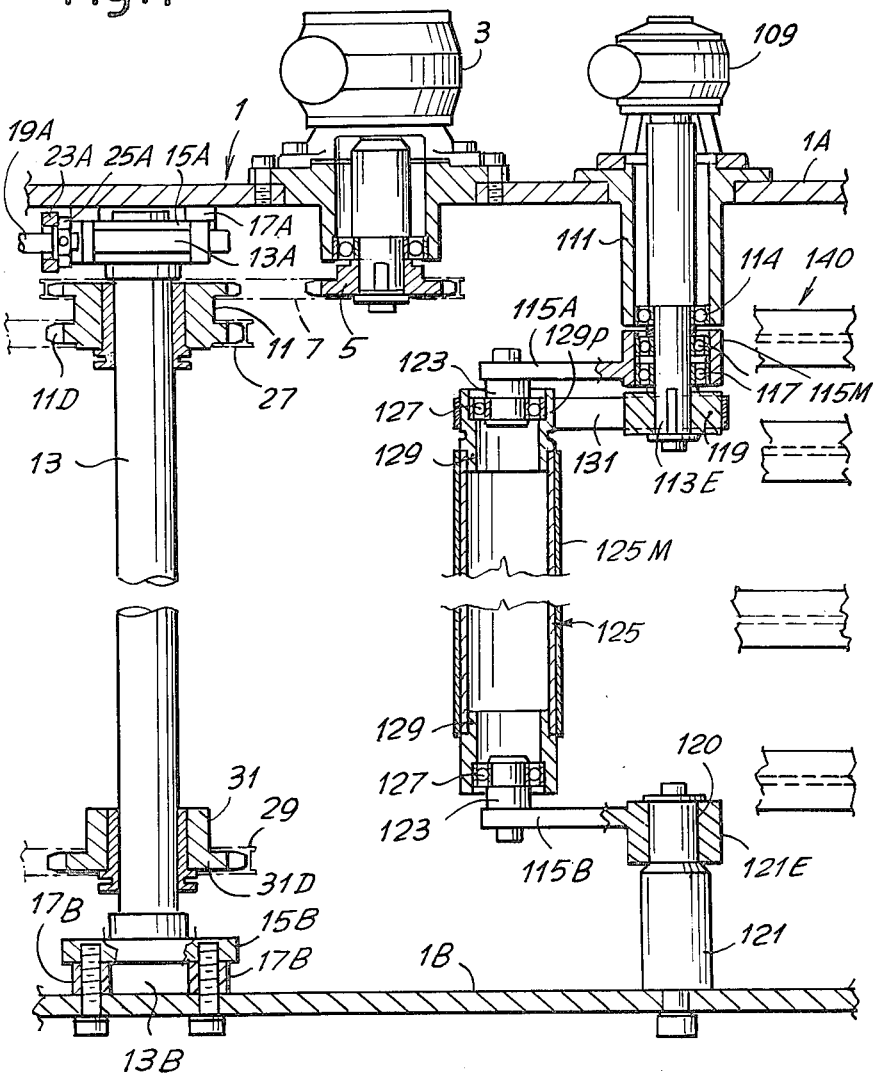
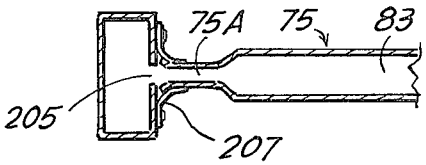
Fig.5

APPARATUS AND METHOD FOR GLUEING THE OUTER END OF A STICK OF WOUND PAPER MATERIAL

This invention relates to apparatus for glueing the outer end of a roll of paper, e.g. toilet paper.

An object of the invention is to provide an apparatus adapted to handle the production of rolls or "sticks" of sanitary paper or the like, glueing the final edge and discharging the finished sticks, the said apparatus being adapted to keep the sticks parallel and advance them transversely of their axes.

The present invention provides apparatus for glueing the outer end of a roll of paper, comprising: a plurality of pairs of support rollers constrained to rotate in the same direction and with the same rotational speed, each pair for receiving a stick of rolled paper, rotating it, stopping its rotation and supporting it during successive operations of the apparatus; an endless chain conveyor means or the like arranged in regular succession for supporting the said pairs of support rollers and transferring them in steps from a receiving station for receiving said stick and opening the outer end of the paper, to a glueing station for applying glue to the end, and to a closing station for closing the end on to the stick; means for rotating in a forward direction at the supporting station a pair of support rollers having a stick supported thereupon, the said means stopping rotation when the end is opened a predetermined amount; means for preventing the rotation of the pair of support rollers in the reverse direction; blast air means for opening the end of a supported stick and a substantially flat projection for supporting an opened end in an approximately horizontal position, which means are substantially parallel and adjacent to the pair of rollers; means for applying glue to the open end supported on the said projection; and means for rotating the stick supported on the pair of support rollers for closing and pressing the end after glueing onto the roll of paper.

The invention will be further described by way of example with reference to the accompanying drawings which show a non-limiting practical example of the invention itself.

FIGS. 3 and 4 show in greater detail and in section part of the view of FIG. 2;

FIG. 5 shows a device for transmitting a vacuum to elements in motion to restrain an end edge for use in the embodiment of FIG. 1.

Figure 1:
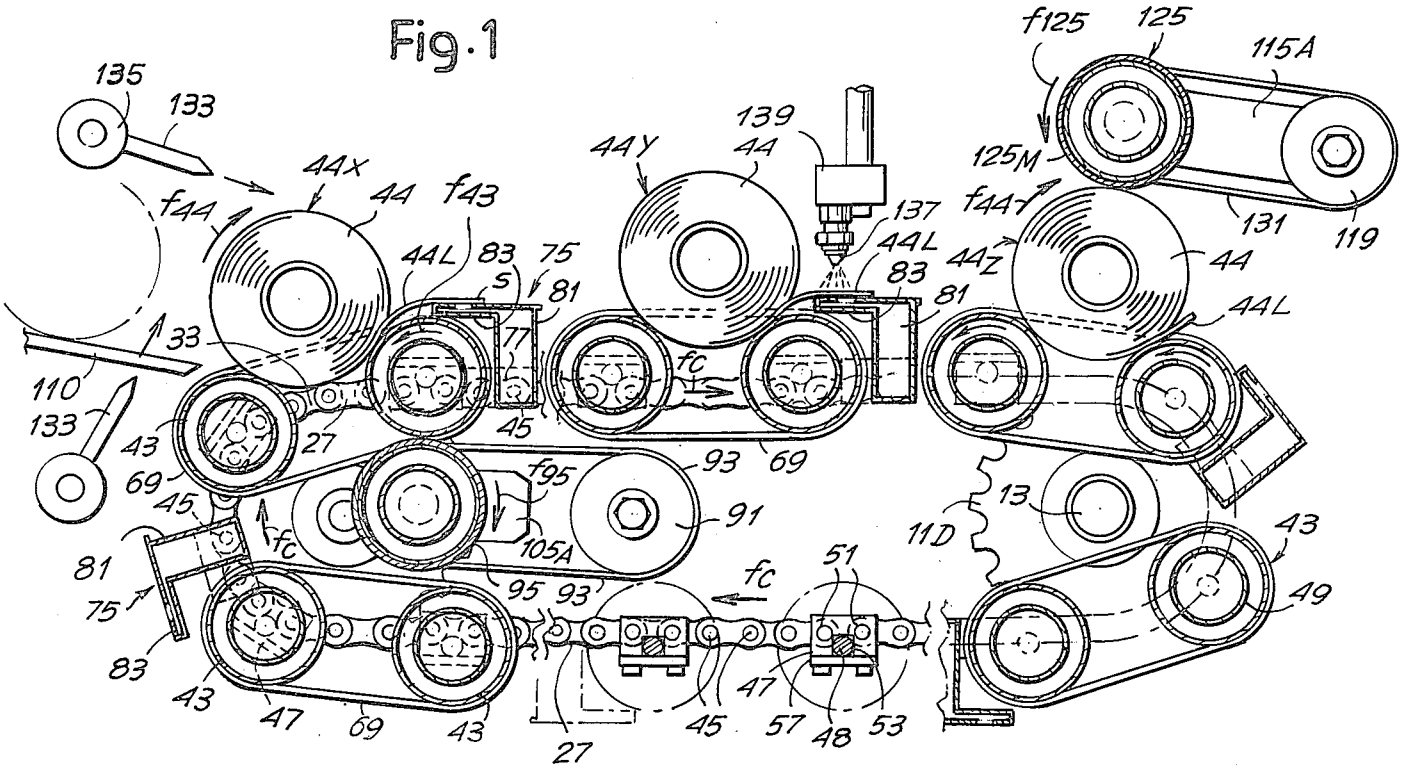
FIG. 1 is a schematic view in section of an apparatus according to the invention.

The drawings show an embodiment of the invention comprising a frame 1 which has two sides 1A and 1B which are parallel to one another, vertical and suitably joined by transverse connection means which are not shown in the drawing. On the side 1A, a motoreducer 3, which may have a self-braking motor, is fixed by suitable flanging means; a pinion 5 for driving a chain 7 is fixed on the end of the shaft of the motor 3. The chain 7, which returns around an idle pinion 9, engages with the outermost teeth of a double-toothed chain gear 11. The pinion 9 idles on a pin 8 which is fixed eccentrically on a stud 6 fixed by means of a bolt 4 to the side 1A. By rotating the stud 6 it is possible to regulate the tension of the chain 7 and to follow the movements of the gear 11; the device is shown in plan in FIG. 2. The chain gear 11 is fixed close to one end of a shaft 13 arranged transversely of the apparatus and supported between internal block bushes 13A and 13B which are smooth-running along the device guides 15A and 15B of the type commonly used to regulate the tension of a chain. The chain tightening devices 15A and 15B are fixed to the sides 1A and 1B by means of columns 17A and 17B. A chain tightening screw 19A may, for example in the drawing, be remote from or press against the block 15A, guided in its rotation between a block 21A and its screwing or unscrewing on the screw thread of a ring nut 23A while a nut 25A acts as a lock nut to prevent rotation of the screw 19A. The chain tightening screw for the device 15B is not shown in the drawing. A chain gear 31, which rotates integrally with the shaft 13, is fixed close to the side 1B and has a single toothing 31D, which is equal to the inner toothing 11D of the gear 11, and the teeth are arranged at the same angular position of the teeth 11D. The teeth 31D and 11D are approximately symmetrical about a central axial direction of the apparatus which is parallel to the sides 1A and 1B; the rotation of the gear 31 integrally with the shaft 13 follows the rotation of the gear 11 which is due to the chain 7. Chains 27 and 29 of roller type of suitable robustness engage on the teeth 11D and 31D respectively, and these chains 27 and 29 are endless and sent to respective chain gears 33 and 35, the teeth of which are of the same number as the teeth 11D and 31D. The gears 33 and 35 are mounted to idle by means of pairs of ball bearings 37 and 39 on the ends of studs 41A and 41B which are of a small diameter and fixed in an opposite and symmetrical position on the sides 1A and 1B. The common axis of the studs 41A and 41B lies in the same horizontal plane as the axis of the shaft 13 so that the upper and lower branches of the chains 27 and 29, which are suitably tensioned, are also approximately horizontal. The chains 27 and 29 are operated by the outermost teeth of the chain gear 11, in order to control the motor 3; the said chains carry pairs of rollers 43 to form a conveyor which moves with the upper branches from the left to the right in the drawing; a stick or bar 44 of a paper strip is supported on the shell of the pairs of rollers 43, having been wound on a core by an automatic winding machine and to be treated so as to fix the outer end of the strip to the roll. To fix the pairs of rollers 43 to the chains 27 and 29 internal extensions 45P of consecutive pairs of pins 45 of the chains 27 and 29, have blocks 47 fixed thereon which are adapted to support cylindrical shafts 48 of the ends of internal tubular bars 49 of the rollers 43. The blocks 47 have holes 51 into which the extensions 45P of the pins 45 enter, an approximately parallelepipedal cavity 53 with a square section which accommodates the shafts 48, and a pair of threaded holes 55; the cavity 53 is closed by superimposing on each block 47 a plate 57 which is fixed by means of bolts 59 screwed into the holes 55. When the cavity 53 is closed by means of the plate 57 the corresponding shaft 48 in this cavity is blocked which therefore cannot rotate with respect to the plate 57 (See FIG. 1). Split pins or other means for preventing the blocks from untreading are arranged on the ends of the extensions 45P. The blocks 47 are thus anchored between the chains 27 and 29, the pins 45 of corresponding links, so that the blocks anchored to the chain 27 are opposed to those anchored to the chain 29, and the axes of the respective cavities 53 are aligned.

On each of the chains 27 and 29 is fixed a series of consecutive pairs of blocks 47, the blocks of each pair being distanced by a certain number of rollers (three in the drawing) interposed between the links to which the blocks are fixed. In addition the pairs of blocks 47 are spaced apart equally on each chain, (in the drawing between each pair of blocks three chain rollers are interposed so that in the particular example shown, all the blocks 47 are at the same distance one from the other).

With the described layout of the blocks 47 along the chains 27 and 29 and the alignment of the axes of the cavities 53 of blocks 47 in an opposed position on the two chains, pairs of rollers 43 are carried on the chain itself in regular succession. The shell 43M of a roller is covered with material, such as rubber or another material, which is suitable to entrain in rotation, by friction with its own external surface, a stick 44. In the example of the drawing, each roller is formed by the cylindrical tubular shell 43M in the ends of which are inserted and fixed by friction, or with other means, two sleeves 61; the sleeves 61 internally have seats to accommodate bearings 65 which support the rollers 43 which can thus rotate freely with respect to the shafts 48, upon which are mounted the said bearings 65. At the exterior, the sleeves 61 have a groove 67 adapted to engage a resilient endless belt 69 with a circular section (in the drawing) by means of which the rollers 43 of each pair are constrained to rotate together at the same speed and in the same direction. Two by two the shafts 48 are connected to the respective internal tubular bar 49 of each roller 43 by means of conical plugs 71 which have a cylindrical zone, forming a ledge inserted in the said tubular bar 49 with which they are integral. Substantially, the tubular bars 49 have the purpose of offering a very rigid transverse assembly to support the rollers 43 and their load formed by the stick 44. In each pair of rollers 43 between their connections with belts 69, at least one roller is prevented from rotating in one of the two possible directions (clockwise in the drawing) by a free wheeling mechanism (not shown) interposed between the roller 43 and the bar 49, the mechanism however allowing the free rotation of the said roller and therefore of the said pair of rollers in the other direction (anticlockwise in the drawing). In place of the free wheeling devices, collapsed slide blocks with a light action may be provided to allow operation but to avoid spontaneous motions.

On operation of the drive motor 3 the chains 27 and 25 are moved in an intermittent manner in the direction of the arrow fc. A profiled element 75 is fixed transversely between the two chains to the pins 45 of the links of the chains 27 and 29, opposite which is constrained a pair of rollers 43. The profiled element 75 has blocks 77 at the ends for fixing to the ends 45P of the pins 45 of the links indicated, and lateral plates 79 which are integral with the said blocks. To the lateral plates 79 are fixed a tubular crosspiece 81 and a flat plate 83 of considerable size which is superimposed on the crosspiece 81 and projects with respect to the plate 79 superimposing itself approximately halfway on the adjacent roller 43 with respect to which it is almost tangential i.e. slightly distanced in the vertical direction—when the rollers 43 which form a pair are along one of the horizontal branches of the chains 27 and 29.

As will appear below, the flat plate 83 which is developed transversely for a length which is approximately equal to that of the shell of the rollers 43, is intended to support the outer opened end of the paper strip wound on the stick 44. Suction means may be provided to retain this end in position.

On the left (in the drawing) on the side 1A is fixed a flanged sleeve 85 which accommodates the shaft 87 of a drive motor 89. On the end 87E of the shaft 87 is fixed a pulley 91 which, by means of a flat belt, causes the rotation of a transverse roller 95, the shell 95M of which is covered with rubber or another material adapted to transmit motion by friction. The roller 95, the shell of which has an axial length which is equal or slightly less than that of the rollers 43, is formed of the said shell 95M which is tubular and of two sleeves 97 inserted in the ends, in the interior of which are housed bearings 99. The roller 95 can rotate freely supported by the bearings 99 and is entrained in rotation in the direction of the arrow f95 by the motor 89 by means of the belt 93; the flat belt 93 in fact engages its pulley-shaped end 97P which forms part of the external surface of the sleeve 97 from the side of the side 1A. The bearings 99 are fixed on the ends of studs 101 fixed to opposite arms 105A and 105B which are equal to one another; the said arms 105A and 105B are fixed perpendicularly to the end of the respective studs 107A and 107B which are in opposition and coaxial to one another, projecting inwardly from the sides 1A and 1B to which they are fixed by means of nuts 104 screwed onto their threaded end. By means of the concomitant rotation of the studs 107A and 107B the roller 95 can be made to assume the position shown in FIG. 1 in which it entrains in rotation for the entire time required the first roller 43 of the pairs described hereinbefore in the direction of the arrow f43 i.e. anticlockwise. Thus positioned, the roller 95 causes the rotation of the first roller of each pair of rollers 43 each time that—due to the motion of the chains 27 and 29—a pair of rollers 43 reaches the position designated at the top left hand side of FIG. 1 in order to receive a wound stick 44 from the chute 110 of an automatic winding machine. The position of the studs 107A and 107B, of the arms 105A and 105B and therefore of the roller 95 is fixed once and for all on the apparatus so as to cause the rotation of the rollers 43 in the manner described without preventing the successive feed.

In a similar manner to the drive motor 89, a drive motor 109 is fixed to the side 1A of the apparatus by means of a flanged sleeve 11. The shaft 113 of the drive motor 109 is supported by a bearing 114 in the end of the sleeve 11; at its end 113E, which projects beyond the said sleeve towards the interior of the apparatus, an arm 115A is hinged and has an end 115M with a sleeve for this articulation and in the interior of this end are housed two bearings 117. A pulley 119 is then fixed on the end 113E of the shaft 113. Opposite the motor 109 and coaxial with the shaft 113 a stud 121 is fixed to the side 1B, the end 121E of the stud 121 forming a pin for hinging by means of a bush 120 an arm 115B which is similar and in a symmetrical position with respect to the arm 115A. By means of respective studs 123 and bearings 127 the arms 115A and 115B support a roller 125, the shell 125M of which has, like the roller 95, a covering of rubber adapted to transmit motion by friction. The roller 125 is formed by the said tubular shell 125M as well as by sleeves 129, inside of which are seats for bearings 127. The sleeve 129 on the side of the side 1A has a pulley-shaped zone 129P on which is guided a flat belt 131, the movement of which is caused by the pulley 119; consequently the roller 125 for the operation by the motor 109 is rotated in an anticlockwise direction, in the direction of the arrow f125. As will appear below the rotation of the roller 125 has the aim of making the stick 44 rotate in the clockwise direction i.e. in the direction of the arrow f44 to glue down the outer end, when the said stick is supported on rollers 43 in the position shown at the top right hand side of FIG. 1. The possibility of rotating the arm 115A pinned on the end 113E of the shaft 113 and the arm 115B pinned on the end 121E of the stud 121, allows the roller 125 supported on the stick 44 to rotate to accommodate sticks having different diameters. A stop device, not shown, allows the rotation to be limited towards the base of the arms 115A and 115B to maintain the roller 125 in a sufficiently high position to accommodate below it the arm 44, which comes raised from the latter when a stick 44 reaches the position 44Z.

Figure 2:
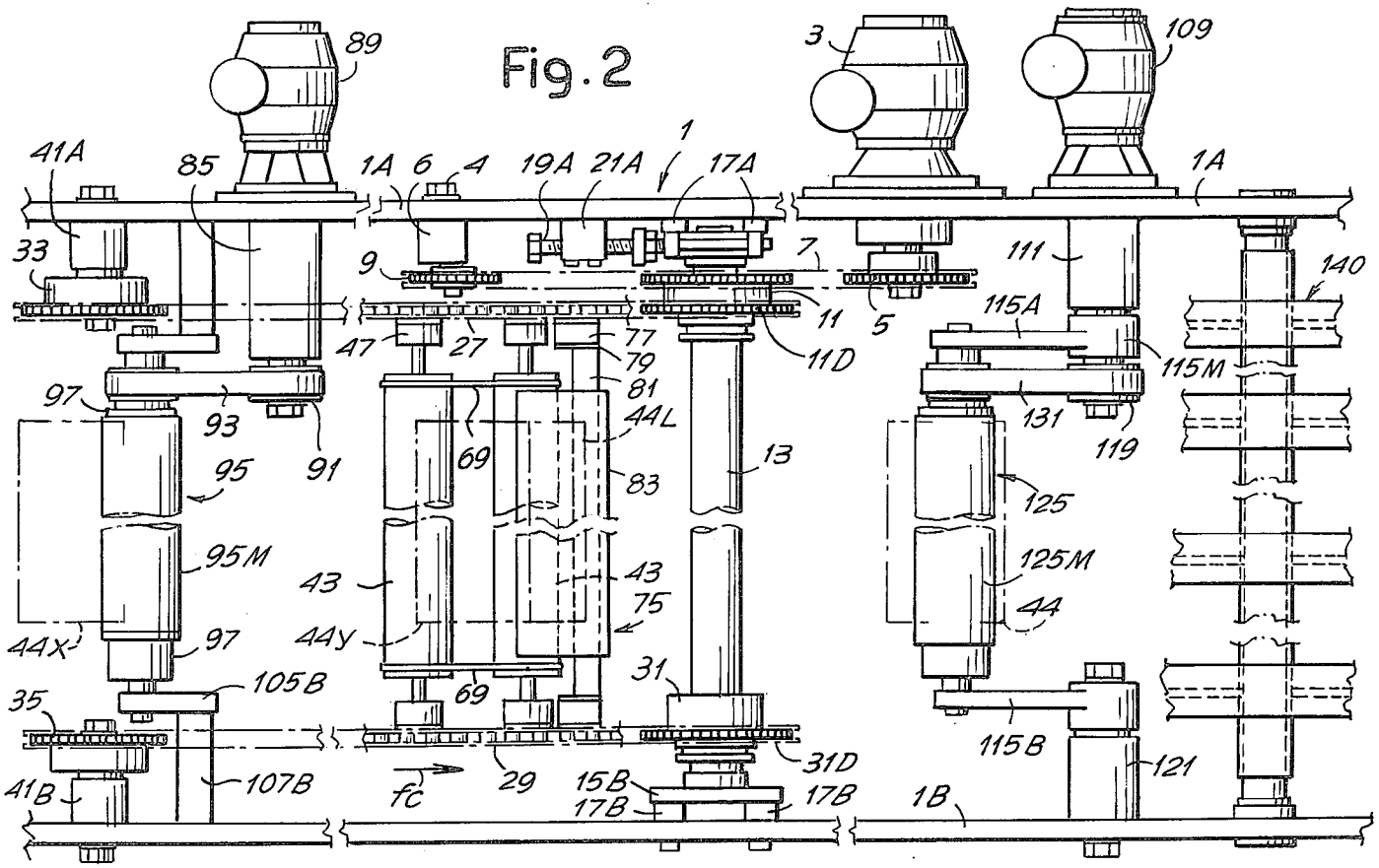
FIG. 2 is a plan view of the development of the apparatus of FIG. 1.
Figure 3:
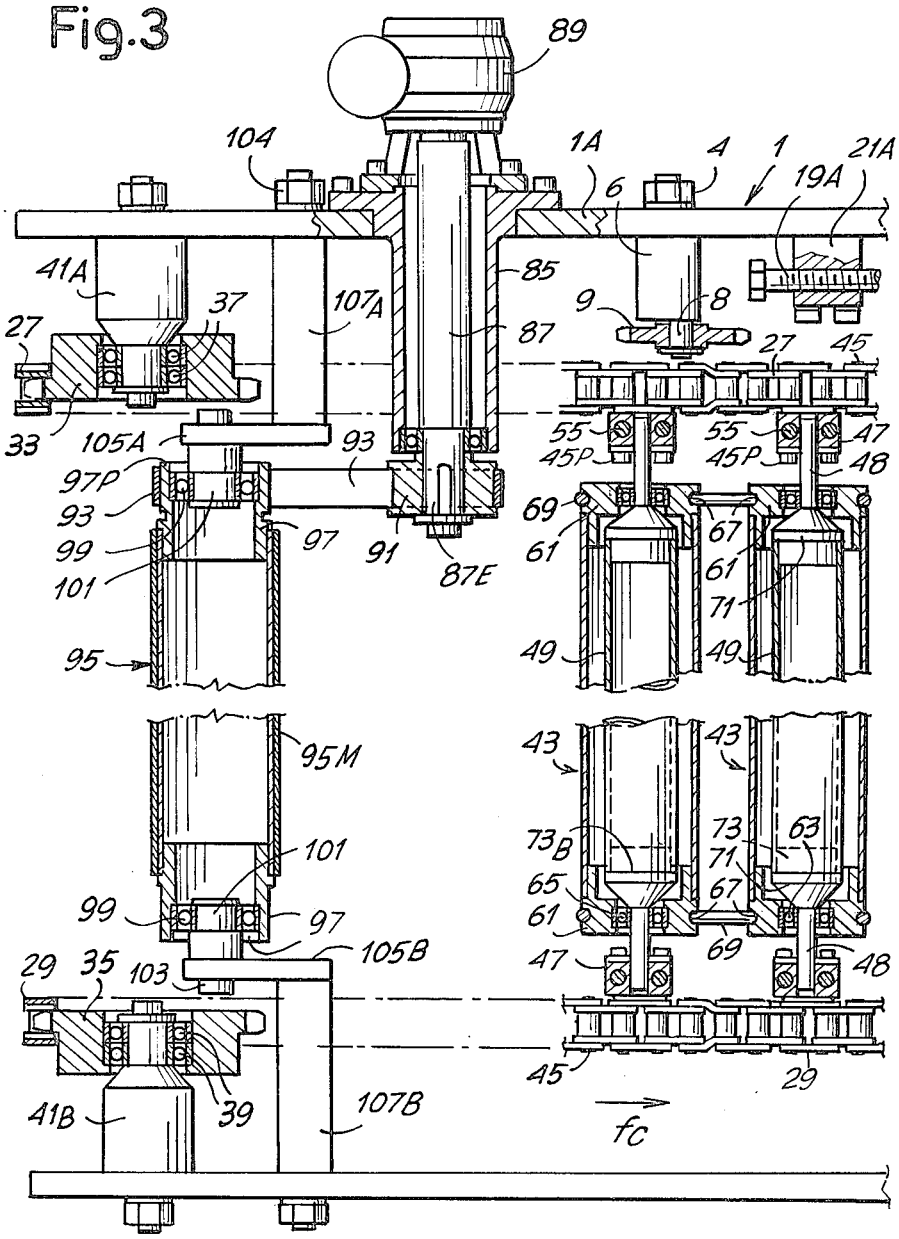

As shown in FIG. 1 the apparatus according to the invention is also equipped with the following other devices: at least one transverse row of nozzles 133, or two rows of nozzles, which are connected and emerge from a single pipe 135 and are adapted to blow air tangentially to the stick in the position 44X to open an edge 44L in order to support it on the plate 83. A nozzle 137, which is vertical to the plate and connected to an adjustment block 139, which is very angular, is driven to and fro transversely of the sides 1A and 1B and is adapted to deliver portions of glue to the base of the open end 44L when a stick 44 is in the position 44Y. After having delievered the glue, the nozzle 137 remains waiting at one side with respect to the roll and close in, in order not to obstruct the movement (towards the right of the drawing) of the stick 44 supported on one pair of rollers 43. When, in the successive phases, a new roll is in the position 44Y, the nozzle 137 carries out a new transverse course, this time in the opposite direction to the previous one and so forth. Alternately, two nozzles can also be provided, each of which complete each time half of the course with respect to that of the nozzle 137 in order to reduce the speed; in this case the nozzles can be raised in the stop phase at the centre of the feed. According to another alternative a plurality of nozzles can be provided along the entire front which can then be fixed or raised and lowered. In all the solutions a possibility of regulating the distance of the glueing zone with respect to the position 44Y of the roll is to be provided. Finally, the glue can be distributed in a continuous or intermittent line, spotting or by spraying or other means.

The apparatus comprises a chute 140 onto which the sticks 44 fall after the end has been affixed, once the latter leave the pair of rollers 43 by which they have been supported during the various operating phases of the apparatus; the said chute 140 therefore transfers the output sticks to a collection site or to the input of a machine adapted to carry out a further operation, e.g. cutting each individual stick into small rolls or otherwise.

The operation of the apparatus according to the invention will be apparent from the preceding description. The chains 27 and 29 move in response to the rhythm of an automatic winding machine (not shown) upstream of the apparatus which discharges one after the other sticks 44 of wound paper strip. The latter, controlled by the motor 3, move in intermittent motion, i.e. in steps, thus making the pairs of rollers 43 assume three successive positions which are those designated at the top of the diagram of FIG. 1 i.e.: a first position for receiving the stick 44 in position 44X and opening the edge 44L; after the positioning of the said edge, a second position for applying glue on the edge 44L of the stick in the position 44Y; and a third position for closing the edge 44L of the stick located in the position 44Z. When the pair of rollers 43 leave the said third position, the roller of the pair which is most advanced in the direction of motion, following together with the chains 27 and 29 the profile of the teeth wheels 11 and 31, is lowered allowing the stick to fall (with the glued edge) onto the chute 140. Therefore there is no "expulsion" position of the roll, the expulsion occurring in the manner described.

With reference to FIG. 1 it can be observed that in the first position 44X the stick 44 which comes from the winding machine supported on the shells of the rollers 43 of the pair of rollers which are in this position. The lower roller 43 of the pair is entrained in rotation in the direction of the arrow f43 i.e. in the anticlockwise direction in the drawing, from the underneath roller 95, with which the latter has come into contact, which rotates in the direction of the arrow f95. The rotation of the two rollers causes the rotation of the stick 44 in the direction of the arrow f44 i.e. in a clockwise direction. During this rotation the air blown by the nozzles 133 causes the edge 44L of the stick to open and the said edge rests on the plate 83. A sensor S (such as a photocell or the like), which is intercepted by the edge 44L, provides a signal which causes the motor 89 to stop immediately and therefore to stop also the rotation of the roller 95 when the latter is in the correct desired position. Consequently the first and the second roller 43 of the pair of rollers stop and therefore also stick 44 with the edge unwound for a fixed length. Due to the presence of the mentioned freely rotating device, the rollers 43 and the stick 44 cannot rotate in the opposite direction with respect to that which has driven it in the first phase described. The pair of chains 27 and 29 and the pair of rollers 43 entrain and orient the stick to assume the position 44Y for applying the glue, shown at the top centre of FIG. 1. The nozzle 137 (or the nozzles) distribute a measured amount of glue and then move to a side (or raised) position in order to allow the subsequent passage of the pair of rollers 43 and the stick. The latter move bearing the stick to the third position 44Z designated in FIG. 1, in which the stick 44 is in contact with the roller 125 which rotates in the direction of the arrow f125. The roller 125 is raised by the stick 44 which is arranged below the latter, this being possible for the rotation of the arms 115A and 115B. The stick 44 is therefore constrained by friction to rotate, supported on the rollers 43, in the direction of the arrow f44, and the reciprocal pressure between the rollers 43 and the external surface of the stick causes the closure and the glueing of the end 44L which rewinds on the stick. The interference between the stick 44 and the roller 125 is maintained constant over the entire diameter of the roll 44, varying the minimum position of the roller 125 by means of suitable adjusting ledges. With the successive passage of the pair of chains 27 and 29, as already mentioned, the stick 44 leaves the pair of rollers, which have supported it during the three phases described, to fall onto the chute 140. It is evident that after each passage of the pair of chains 27 and 29 on three respective consecutive pairs of rollers 43 there is simultaneously a phase for receiving a stick and opening the end of the stick which has just arrived, a phase for applying glue on the open end of a stick which has already passed the first phase, and a phase for closing the end on a stick which has already undergone the operations at the two preceding stations. At each passage therefore of the conveyor formed by the chains 27 and 29 a stick to be closed arrives on the apparatus and is discharged therefrom once it has been closed.

In order to ensure that the edge 44L rests on the surface 83 of the element 75, the latter may have suction openings; a vacuum in the tubular crosspiece 75 (see FIG. 5) can be obtained by connecting the the latter at a lateral front end to a suction slot 205, which normally remains closed, by means of a pair of resilient longitudinal lips 207; the latter are raised by a squashed selvedge 75A brought from the end of the tubular crosspiece 81, 83.

Advantages provided by the apparatus with respect to similar apparatus of the prior art will be apparent to those in the art. For glueing the edge it is not necessary to provide and insert the core of the roll or stick on a mandrel in order to obtain rotation and therefore transverse i.e. lateral entrainment of the stick is not necessary. In addition the apparatus can easily be synchronized with the productive rhythm of an automatic winding machine upstream from the latter and with which it works in line, thus forming a complete unit in a certain sense. The wound sticks are closed for glueing by the apparatus in question, and are discharged moving in the same output direction of the winding machine.

It is understood that the drawings show only one embodiment by way of example. Various modifications will be apparent to those skilled in the art and it is desired to include all such modifications without however departing from the scope of the concept of the invention itself as defined by reference to the accompanying claims.

Having described my invention, what I claim is new and desire to protect by Letters Patent are the following:

1. An apparatus for glueing the outer end of a web of paper which has been wound into a roll, said apparatus including a plurality of pairs of rollers arranged to receive and support a roll of paper, a conveyor for carrying the pairs of rollers, drive means for the conveyor to move each pair of rollers in sequence from a receiving station to a glueing station to a closing station, drive means to rotate the rollers of each pair whereby to unwind the end of the web from the roll, a support for said unwound end located adjacent one roll of each pair, an applicator for applying adhesive to the unwound end while it is on the support in the glueing station, means adjacent the closing station to rotate the roll whereby to re-wind the end of the web with the glue thereon onto the roll.

2. The apparatus of claim 1 wherein a support for said unwound end is located between each pair of rollers.

3. The apparatus of claim 1 wherein the adhesive applicator is an oscilating glue spray.

4. The apparatus of claim 1, including at least one air jet adjacent the receiving station to assist in unwinding the end of the web from the roll.

5. The apparatus of claim 1 wherein said support includes vacuum means for holding the web against the support in the glueing station.

6. The apparatus of claim 1 wherein the means for rotating the roll in the closing station includes a pressure mechanism to assist in pressing the glue-carrying end of the web against the roll.

7. The apparatus of claim 6 wherein said pressing means is adjustable so as to accommodate rolls of varying diameters.

8. The apparatus of claim 1 including discharge means adjacent the closing station constructed and arranged to carry the roll away from the apparatus when the end of the web is re-wound against the roll.

9. The apparatus of claim 1 including a web-sensing mechanism to stop the roll-rotating drive means when an adequate portion of the web is disposed upon the web-support.

10. The apparatus of claim 9 wherein said sensing mechanism is a photoelectric cell.

11. The method for winding a web of paper into the roll and for glueing the end of the web against the roll, said method including winding a web of paper into a roll, placing the roll on a carrier at a receiving station, rotating the roll to unwind the end of the web, moving the web at a right angle to the roll-axis to a glueing station, supporting the end of the web beneath an adhesive applicator at the glueing station, applying adhesive to the end of the web while it lies upon the support, moving the roll at a right angle to the roll-axis to a closing station, rotating the roll to re-wrap the end of the web against the roll, discharging the roll from the carrier.

12. The method of claim 11 wherein said rolls are rotated only at the receiving station and at the closing station.

13. The method of claim 11 wherein pressure is applied against the roll to force the glue-carrying end of the web against the roll in the closing station.

14. The method of claim 11 wherein the roll is discharged from the conveyor in a direction at a right angle to the roll-axis.

* * * * *